United States Patent [19]

Kirkpatrick et al.

[11] Patent Number: 5,020,175

[45] Date of Patent: Jun. 4, 1991

[54] MULTICOMPARTMENT CUSHION COMPRISING RECYCLABLE PLASTIC BOTTLES

[76] Inventors: Paul A. Kirkpatrick, 422 Truby St., Greensburg, Pa. 15601; Marvin L. Kahn, 12328 Areaca Dr., West Palm Beach, Fla. 33414

[21] Appl. No.: 485,481

[22] Filed: Feb. 27, 1990

[51] Int. Cl.[5] ..... A47C 27/08; B65D 85/66; B63C 9/08

[52] U.S. Cl. ..... 5/448; 5/420; 5/449; 5/455; 441/47; 441/129; 206/430

[58] Field of Search ..... 5/417, 420, 448, 449, 5/455, 457; 441/44–47, 50, 54, 66, 125–127, 129, 130; 206/430

[56] References Cited

U.S. PATENT DOCUMENTS

| | | | |
|---|---|---|---|
| 19,216 | 1/1858 | Taggart . | |
| 42,594 | 5/1864 | Park . | |
| 689,020 | 12/1901 | Pruden . | |
| 1,727,902 | 2/1929 | Reno . | |
| 2,036,548 | 4/1936 | Silvernail | 441/66 |
| 2,206,160 | 4/1939 | Carroll . | |
| 2,374,372 | 10/1943 | Moss . | |
| 3,042,940 | 7/1962 | Keaton | 5/449 |
| 3,060,463 | 10/1962 | Pentzien . | |
| 3,128,478 | 4/1964 | Beal . | |
| 3,596,622 | 8/1971 | Moore . | |
| 3,618,144 | 11/1971 | Frey et al. | 5/448 X |
| 3,663,976 | 5/1972 | Momany . | |
| 3,765,353 | 10/1973 | Rosenberg . | |
| 3,878,803 | 4/1975 | Leverton . | |
| 3,895,593 | 7/1975 | Moore . | |
| 4,542,826 | 9/1965 | Adams | 206/430 X |
| 4,652,246 | 3/1987 | Thorgeirsson . | |
| 4,808,133 | 2/1989 | Gram . | |
| 4,824,411 | 4/1989 | McClanahan | 5/455 X |
| 4,924,541 | 5/1990 | Inagaki | 5/449 X |

FOREIGN PATENT DOCUMENTS

| | | | |
|---|---|---|---|
| 159299 | 2/1921 | United Kingdom | 5/455 |

*Primary Examiner*—Michael F. Trettel

*Attorney, Agent, or Firm*—Fisher, Christen and Sabol

[57] ABSTRACT

The present invention provides cushions comprising sheets connected together to define at least one compartment, which is filled with a plurality of gas-filled containers such as used or discarded plastic beverage bottles. The present invention also provides bag-like, multi-compartmented containers or advertising means for producing the cushions. The cushions can be adapted for use as a sunning mat, raft, surfing device, sleeping bag base, pool cover, pool lane marker, road crash barrier, storage and moving mat, temporary shelter or tent, and the like.

20 Claims, 11 Drawing Sheets

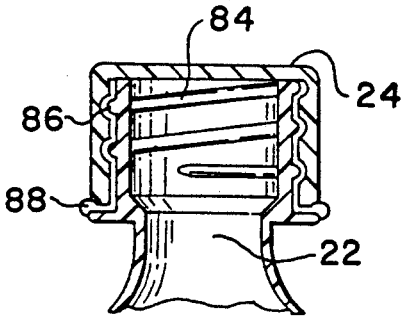
FIG. 16
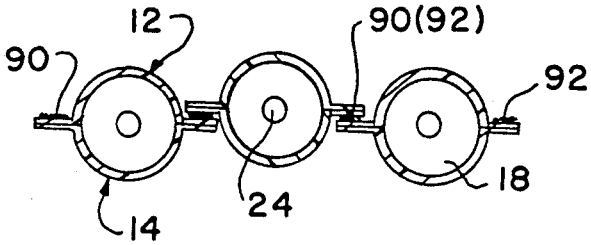
FIG. 17A
FIG. 17B
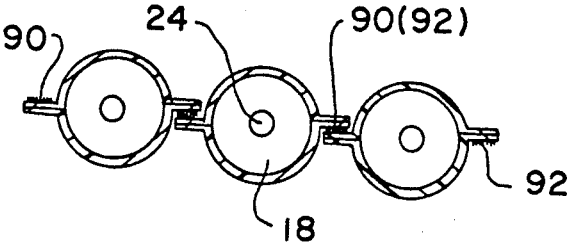
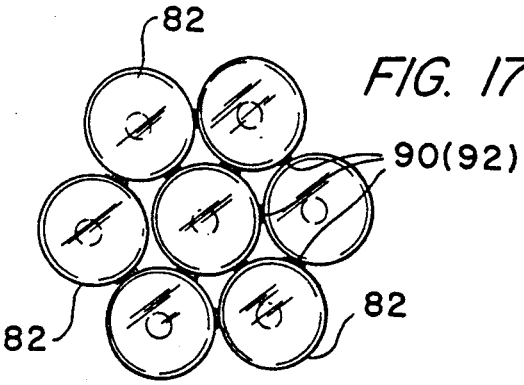
FIG. 17C
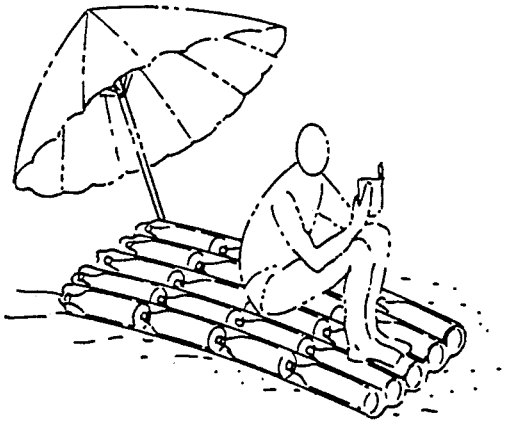
FIG. 18A

MULTICOMPARTMENT CUSHION COMPRISING RECYCLABLE PLASTIC BOTTLES

FIELD OF THE INVENTION

The present invention relates to a multicompartment bag-like container for recycling plastic bottles and to cushions made therefrom. The cushions can be used as a structural member, raft or float, mattress, pool cover, pool lane marker, highway barrier and the like.

BACKGROUND OF THE INVENTION

The present invention relates to recycling or utilizing discarded empty beverage containers such as the popular one and two liter plastic bottles or other major selling sizes commonly used for bottling of carbonated sodas such as Coca Colas®, Pepsi Cola®, Sunkist®, 7-UP®, and Diet Rite Cola®. In the present invention, discarded bottles may be collected to form other utilitarian objects such as a raft or float, mattress, structural member, highway barrier or other cushioning means. After a period of use of the cushioning means, the bottles contained therein are in a collected form for recycling or reprocessing or disposal. The invention is particularly advantageous for the production of inexpensive seasonal items such as buoyant rafts or floats.

An empty plastic bottle is disclosed as being used as a marker float for an anchor in Gram et al. U.S. Pat. No. 4,808,133. Floatation devices made from interconnected buoyant members which are interconnected to each other by gluing or cementing, by rods, or ropes, for example, are disclosed in Taggart U.S. Pat. No. 19,216, Park U.S. Pat. No. 42,594, Pruden U.S. Pat. No. 689,020, Reno U.S. Pat. No. 1,727,902, Carroll U.S. Pat. No. 2,206,160, Moss U.S. Pat. No. 2,374,372, Pentzien U.S. Pat. No. 3,060,463, Beal U.S. Pat. No. 3,128,478, Moore U.S. Pat. No. 3,596,622, Momany U.S. Pat. No. 3,663,976, Rosenberg U.S. Pat. No. 3,765,353, Moore U.S. Pat. No. 3,895,593, and Thorgeirsson U.S. Pat. No. 4,652,246 deceased et al. Gas containing cans are used in the device of U.S. Pat. No. 3,596,622. Bottle members are used in the devices of U.S. Pat. Nos. 3,765,353 and 3,895,593.

Leverton U.S. Pat. No. 3,878,803 relates to a can float pontoon wherein a plurality of empty beer and beverage cans are placed in cylindrical plastic tubes to provide rigidity to the tubes.

The present invention provides a multicompartment bag-like container for recycling plastic bottles wherein the bottles provide cushioning and are maintained in alignment by the container without fixed attachment to the container and without attachment to each other. The bottles may be readily removed from the container for reprocessing. The bottles impart buoyancy to the cushions which make them useful as rafts. The container and cushions made from the container may be used as an advertising media by carbonated soda bottling companies for example.

SUMMARY OF THE INVENTION

The present invention relates to a flexible bag-like multi-compartment container for recycling plastic bottles. In a preferred embodiment the container and cushions made therefrom serve as an advertising media by providing advertising indicia on a portion of the cushion. The cushioning devices of the present invention incorporate a plurality of containers at least partially filled with a gas, preferably air, for providing floatation, cushioning, structural support and other useful functions such as sound or thermal insulation.

A preferred embodiment of the present invention is a buoyant cushion or raft. This embodiment may incorporate a plurality of used or discarded one and/or two liter plastic beverage bottles in which the bottles are completely emptied of liquid, filled with air and the caps are securely tightened to the openings of the bottles to provide airtight and watertight seals. The cap may be glued or caulked to the bottle to ensure no leakage of fluid and/or gas into or out of the bottle during use of the cushion.

The cushions of the present invention can include one or more flexible sheets of material, preferably plastic, in which a portion or portions of the one or more sheets are connected together to form a plurality of compartments. One or more discarded beverage bottles are inserted within each compartment to provide the final cushion. The sheets may, for example, be from about 1 mil to about 10 mil, preferably from about 4 mil to about 6 mil in thickness. In preferred embodiments at least one of the sheets of the cushion has a substantially flat portion for facilitation of including indicia. Preferably the flat portion extends across a plurality of compartments.

In embodiments of the present invention a plurality of compartments are each provided with one or more plastic bottles in order to provide an article of sufficient size and shape to meet its utilitarian function. For example, a raft constructed according to the present invention can incorporate five to twenty two, preferably 5 to 8 longitudinal compartments positioned side-by-side with each compartment filled with four or five two-liter plastic bottles positioned in a bottom-to-top arrangement.

Cushions may be produced which have a different degree or substantially the same degree of flexibility or rigidity in different portions by the end-to-end placement of the bottles in the compartments. This may be accomplished, for example, by arranging at least a portion of the bottles in at least one compartment such that only every other bottle has its bottom facing the same direction whereby a repetitive neck-to-neck, base-to-base configuration is obtained.

In a preferred embodiment for a raft, at least a portion of the bottles are arranged in neck-to-neck or base-to-neck relationship to provide at least one flexible region to said cushion which configures to the human body so as to increase comfort.

A portion of the bottles may be arranged in base-to-base relationship to provide regions which are more rigid than regions which contain bottles in neck-to-neck or base-to-neck relationship. A neck-to-neck relationship provides the greatest flexibility followed by a neck-to-base (or base-to-neck) relationship. A cushion wherein at least substantially all adjacent bottles are oriented in opposing directions reduces flexibility of the cushion. A cushion wherein at least substantially all of the bottles are oriented in the same direction increases flexibility.

The bag-like containers of the present invention include an access to allow one or more air-filled containers to be inserted into one or more compartments of the container. Further, the container is preferably provided with a closure for each compartment access to seal or retain the loaded containers therein. The compartments are configured to receive and maintain a given bottle in substantial alignment with another bottle in an end-to-end relationship. A given compartment may contain aligned bottles in end-to-end relationships such as neck-to-neck, base-to-base, base-to-neck, or combinations thereof.

The sheets of material, as mentioned above are preferably plastic material, but could be other materials such as rubber impregnated canvas, water resistant cloth, rubber and rubber composites, high strength composite fibers, etc. Further, the sheets can be formed of air and/or water impermeable or permeable type materials. In one embodiment, a netting type material or a perforated sheet material is utilized to form the compartments of the cushion relying on the air contained within the containers providing the floatation, structural stiffening, or other functions of the cushion. The use of perforations in the material which forms the compartments is preferred for floatation devices. Without the perforations, water which may leak into and collect in the compartments (but not into the buoyant bottles) could be difficult to remove, could add excess weight for carrying and could decrease buoyancy. The perforations provide drainage without substantial loss of buoyancy.

The means for closing each compartment can be provided by many known devices such as snap fasteners, zippers, resealable strips, flaps, glue or adhesives and other means. The closure or seal can be of a type that is permanently closed once the air filled containers are inserted in the compartments of the container. It can also be of a type that will allow many cycles of opening and closing for changing the number of containers within the compartment or replacing containers therein.

The cushion can be utilized in many ways. The cushions can be combined to form useful devices or objects. For example, a cushion may comprise a plurality of cushion units or sections each defined by a single compartment longitudinal container having a plurality of longitudinally aligned buoyant bottles in end-to-end relationship, with the units or sections being attached end-to-end to form lane markers of a swimming pool for swim practice or racing. In the case of a highway crash barrier, a plurality of single compartment containers each filled with a plurality of air-filled or liquid filled bottles which are maintained in end-to-end relationship can be bundled together and surrounded with an outside container or casing to provide the completed crash barrier structure.

The cushions can be attached to other cushions or structures to make a completed utilitarian object or device with means for disassembling the object or device temporarily for storage or moving. For example, single compartment cushions each having a plurality of air-filled containers can be attached side-by-side by longitudinal Velcro® strips to form a completed raft ready for use. The single compartments can then be detached from each other by separating the Velcro® strips and then bundled to facilitate storage in the trunk of a vehicle on the way home, for example, from the beach.

BRIEF DESCRIPTION OF THE DRAWINGS

FIG. 16 is a cross-sectional view of the opening to the neck of a plastic bottle having a cap with a silicone seal positioned therein;

FIG. 17A is a cross-sectional view of a plurality of separate cushions connected together by Velcro® strips;

FIG. 17B is a cross-sectional view of an alternative manner of connecting separate cushions together by Velcro® strips;

FIG. 17C is a cross-sectional view of a plurality of separate cushions of the type shown in FIG. 17A bundled together by Velcro® strips;

FIG. 18A is an illustration of a cushion according to the present invention adapted for use as a sunning mat at the beach;

DETAILED DESCRIPTION OF THE INVENTION

Figure 1:
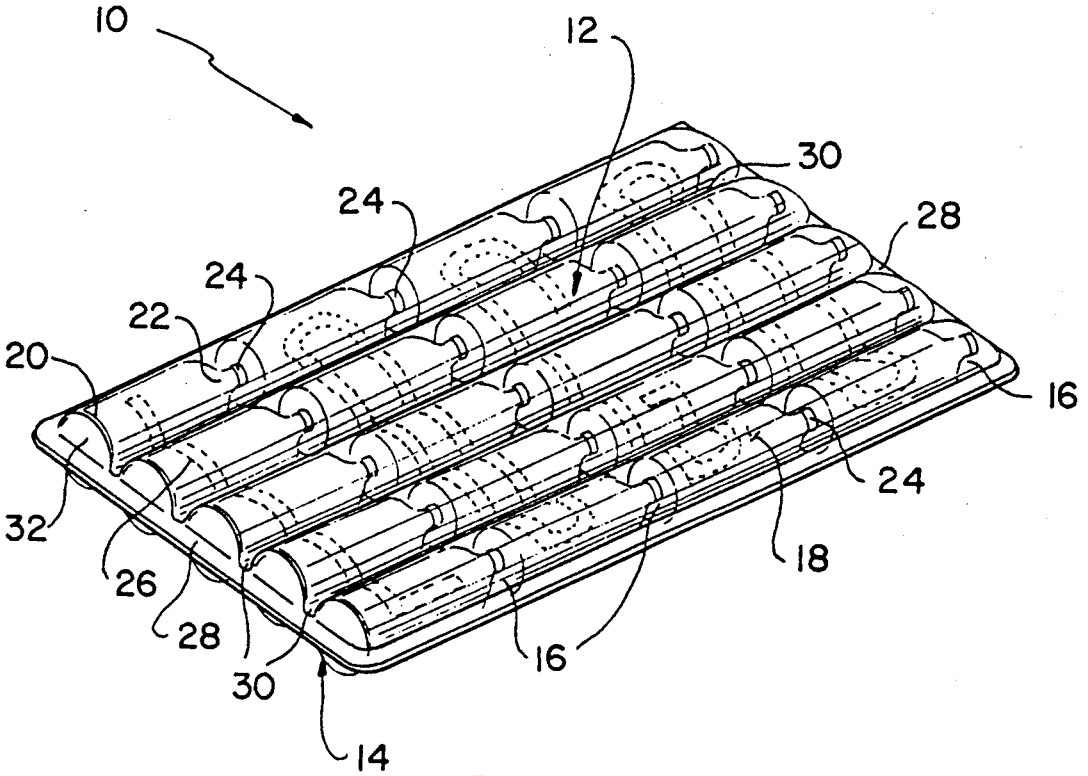
FIG. 1 is a perspective view of an embodiment of the cushion, according to the present invention.

An embodiment of a cushion 10 according to the present invention is shown in FIG. 1. This particular cushion 10 comprises an upper flexible sheet 12 connected to a lower flexible sheet 14 at the perimeter of the sheets and along four (4) longitudinal rows to define a plurality of compartments 16. The upper sheet 12 and lower sheet 14 can be a single sheet prior to construction or can be separate sheets. Further, each sheet can be made of separate component sheets connected together to make up the desired size and shape overall sheet or can be a composite sheet made of one or more layers of material.

Exemplary materials for the sheets include thermoforming and thermosetting plastics such as low, medium and high density polyethylenes, polyethylene terephthalate, polyvinyl chloride, and materials such as rubber, cloth impregnated with rubber, canvas, flexible composites and the like. The sheets of material should be flexible enough to provide cushioning while having sufficient tensile strength to withstand typical loads during use. The flexible sheets may, for example, have a thickness of from about 1 mil to about 10 mils preferably from about 4 mils to about 6 mils. Further, the flexible sheet of material can be made of heat shrinkable material, such as heat shrinkable plastic film, to form a final structure wherein the containers are tightly held between the sheets after construction.

The compartments 16 are each filled with a plurality of gas-filled containers such as bottles 18. The containers can be partially or completely filled with gas. Liquid filled, or partially liquid filled bottles or containers may be used in cushioning devices where buoyancy is not needed, such as for highway crash barriers. Further, the gas will typically be air due its economical advantage versus other gases, in combination with its desirable properties of being non-flammable and non-toxic.

The containers can be custom tailored in size, shape and construction for the particular application of the cushion, but they are preferably used or discarded beverage containers such as the popular one-liter and two-liter plastic carbonated beverage bottles made of polyethylene terephthalate. An important objective of the present invention is the incorporation of such used or discarded beverage bottles into useful products to provide a true recycling of a waste product that is readily available and could be considered a litter nuisance or a burden on land fills or dumps. The bottles are not connected to each other or to the flexible sheets by gluing or tieing, for example, and can be easily separated from each other and from the flexible sheets without destroying their integrity.

The containers can be made of various materials such as plastic(s) or metal(s) or combinations thereof. Preferably, the containers and their caps are made of plastic, and of the same type as the flexible sheets to facilitate recycling the cushion as a whole unit. If the cushion is made entirely of the same type of plastic, there would be no need to separate parts or portions of the cushion during recycling.

In the embodiment of the cushion shown in FIG. 1, the containers are shown as having the shape of used or discarded beverage bottles 18 with each having a bottom portion 20 and a top neck portion 22 provided with a cap 24 to seal air within each of the bottles 18. Further, the discarded beverage bottles 18 are arranged with the cap of one bottle abutting the bottom of the next bottle positioned adjacent thereto. Other arrangements of these discarded beverage bottles can be made to vary the bending points and rigidity of the completed cushion, and tailored to a particular use.

Figure 2:
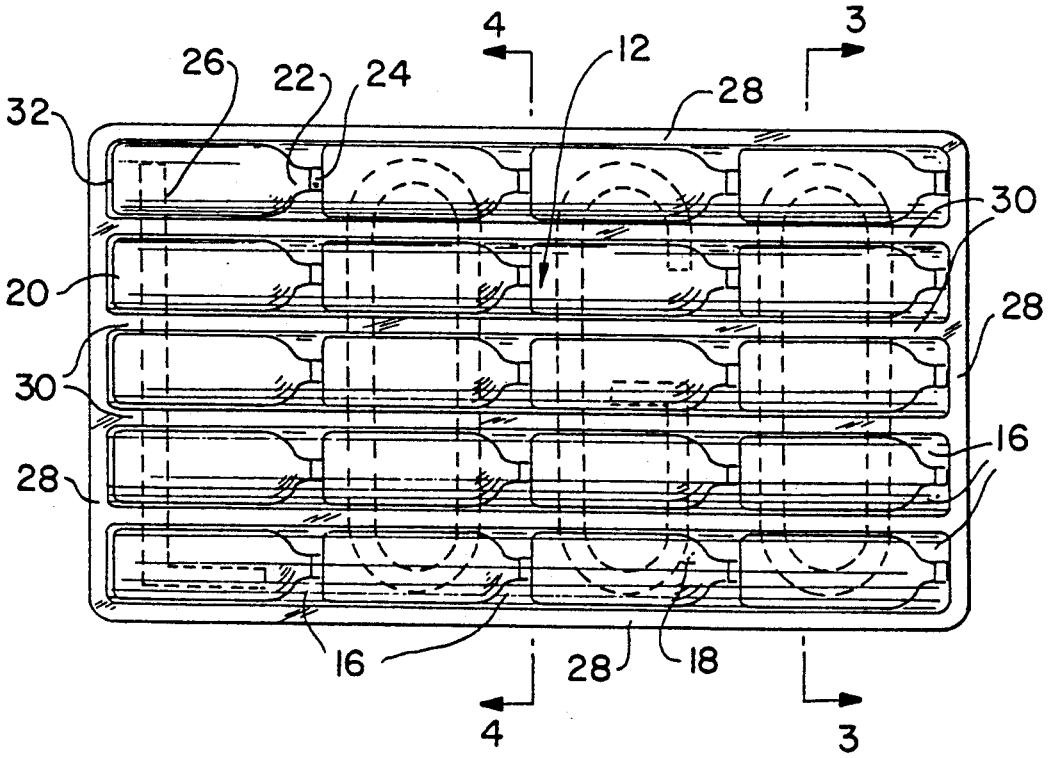
FIG. 2 is a top view of the cushion, as shown in FIG. 1.

An important feature of the cushion of the present invention can be provided by printing a logo 26 on one or more surfaces of the flexible sheets of the cushion as shown in FIG. 2. Typically the logo 26 will be a trademark, tradename or service mark for advertisement purposes making the cushion an effective advertisement tool. Cushions printed with such logos could be given away or sold at discounted prices to consumers to provide passive advertisement for the particular business. The logo or other indicia may be printed on opaque, translucent, transparent, or clear sheets in known manner.

Figure 3:
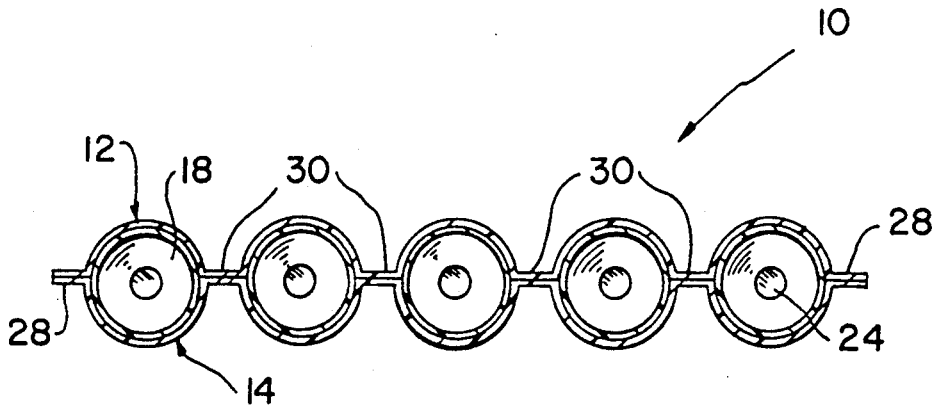
FIG. 3 is a cross-section of FIG. 2 taken along the line 3—3, as shown in FIG. 2.
Figure 4:
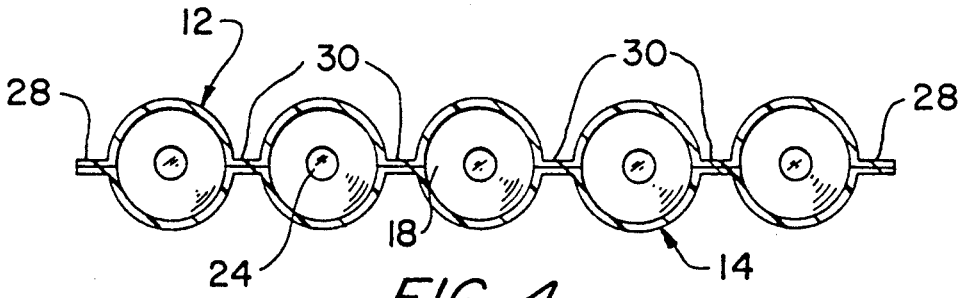
FIG. 4 is a cross-section of FIG. 2 taken along the line 4—4, as shown in FIG. 2.

FIG. 3 is a cross-sectional view of the cushion 10 shown in FIG. 2 at 2—2. The flexible sheets 12 and 14 are shown as single layers connected together at the perimeter portion 28 and row portions 30. FIG. 4 is another cross-sectional view of the cushion 10 shown in FIG. 2, at a position where the caps 24 abut the bottoms 32 of the bottles 18. The flexible sheets can be connected together, for example, by adhesive or heat welding.

Figure 5:
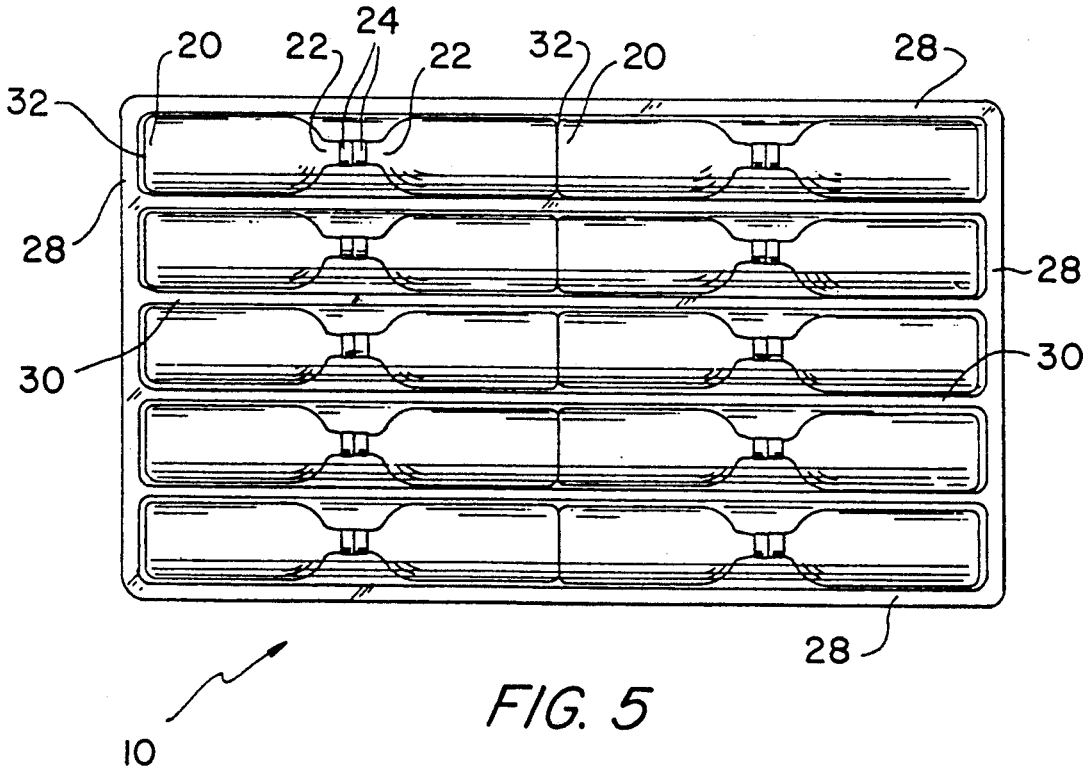
FIG. 5 is a top view of another embodiment of the cushion according to the present invention.

The bottles 18 can be arranged in various manners, as mentioned above. As a further example to that shown in FIG. 1, the bottles 18 in the embodiment of the cushion shown in FIG. 5 are arranged cap-to-cap or neck-to-neck and bottom-to-bottom to basically provide two joints at which the cushion can be bent to a certain extent. The two joints will be defined in the proximity where the cap-to-cap or neck-to-neck locations are situated. These joint portions may be made to coincide with a person's neck or knees in a buoyant raft, for example.

Figure 6:
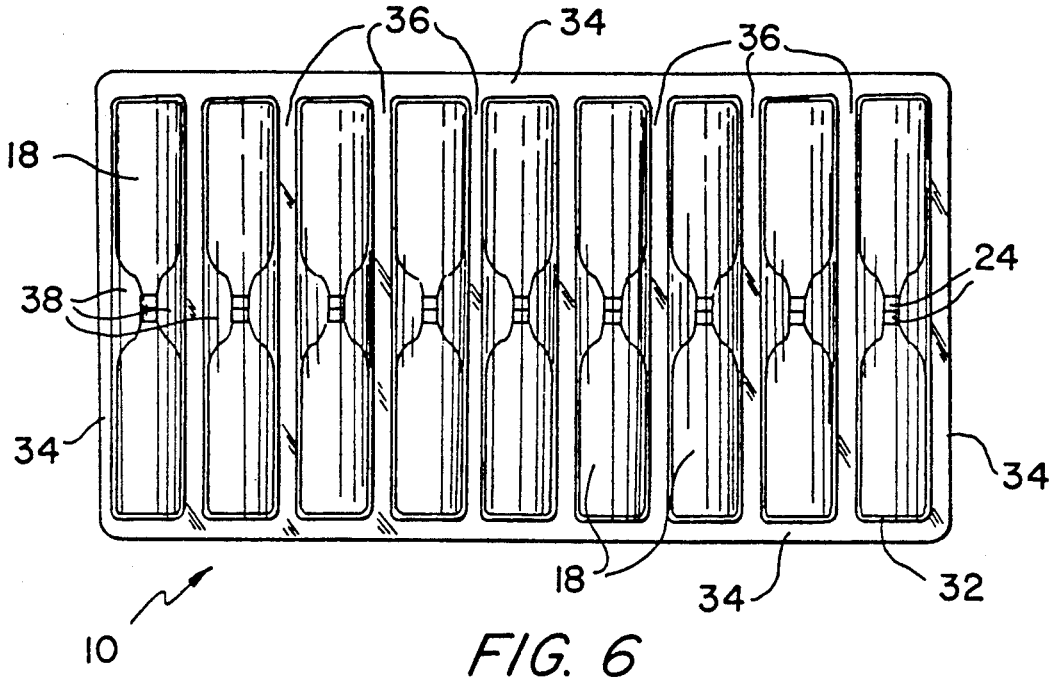
FIG. 6 is a top view of a further embodiment of the cushion according to the present invention.
Figure 7:
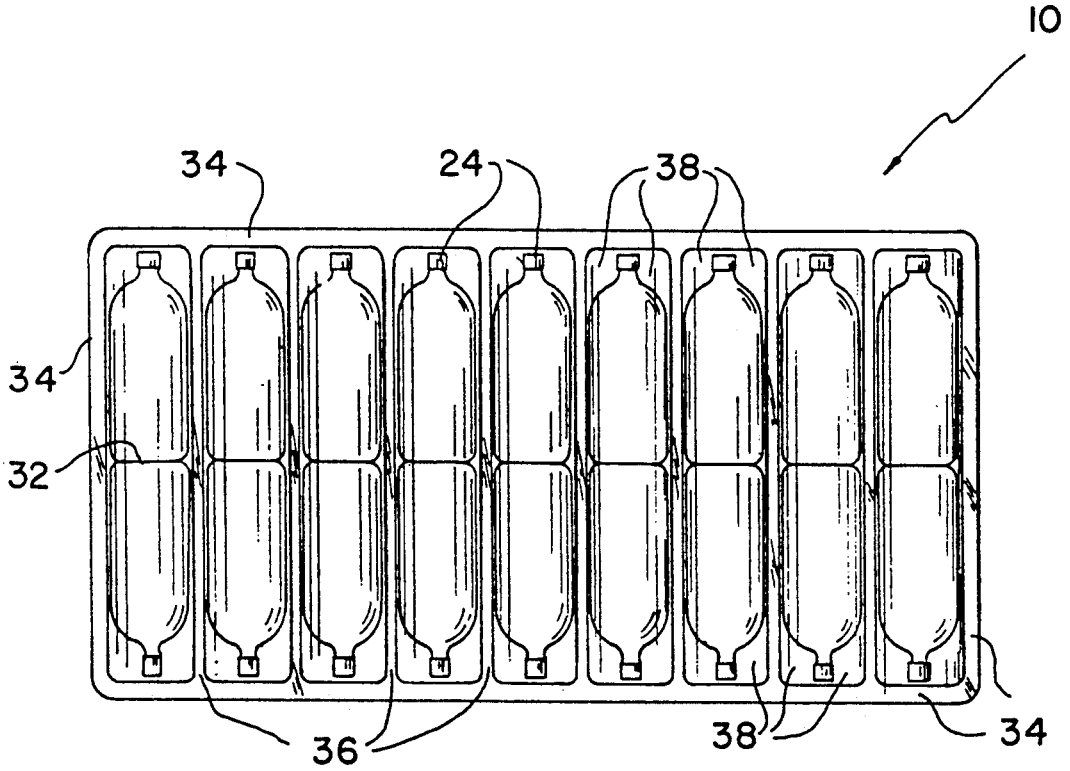
FIG. 7 is a top view of an alternative embodiment to that shown in FIG. 6.

Another embodiment of the cushion 10 according to the present invention is shown in FIGS. 6 and 7. In this embodiment, the flexible sheets are connected together at perimeter portions 34 and at a plurality of transverse row portions 36 defining a plurality of transverse compartments 38. In the embodiment shown in FIG. 6, the bottles 18 are arranged cap-to-cap or neck-to-neck, and in the embodiment shown in FIG. 7 arranged bottom-to-bottom. Thus, the arrangement shown in FIG. 6 would provide a central longitudinal joint that could act as a longitudinal hinge while the embodiment shown in FIG. 7 is substantially rigid along its central longitudinal axis due to the reduced possibility for relative angular movement between the bottoms of the bottles 18 which are confined in the transverse compartments 38. In the embodiments of FIGS. 6 and 7, the cushions are flexible in the lateral direction along the seal lines forming the row portions 36.

The cushion according to the present invention could be sold to the consumer as a fully constructed product or as a product that would require some assembly. In the case of the fully constructed product, the gas-filled containers can be inserted through access openings to the compartments and then sealed in place by some type of more permanent type seal such as a heat welded seal to provide longevity. Alternatively, the cushion can be constructed by arranging the gas-filled containers in a specific arrangement on one sheet followed by covering the arrangement and connecting portions to form compartments around the containers such as by heat sealing portions around each container or forming compartments for columns of containers.

In the case of a non-fully assembled product, the consumer can be responsible for finishing the construction of the cushion. Preferably, the consumer is provided with or sold a bag-like container having a plurality of compartments in which the consumer positions air-filled beverage bottles to finish assembly of the cushion. The compartments are preferably configured to have substantially the same diameter as the maximum diameter of the bottles inserted therein. The compartments are preferably sized to be of sufficiently large diameter or cross-section so as to provide relative ease of insertion of the bottles therein. They should be sufficiently small in diameter or cross-section so as to maintain the bottles in end-to-end alignment. The maximum clearance between the side wall of a bottle and the inner wall of the compartment may, for example, be less than the diameter of the neck-end of the bottle so as to prevent a neck portion from extending past the bottom end portion of the next longitudinally aligned bottle. In embodiments of the invention the consumer may further restrict the diameter of the compartments or even form the compartments after placement of bottles within a flexible bag-like container by heat sealing, sewing, or the like. The compartments may be sized so that substantial contact results between the inner surface of the compartments and the circumferential portions of the bottles.

Figure 8A:
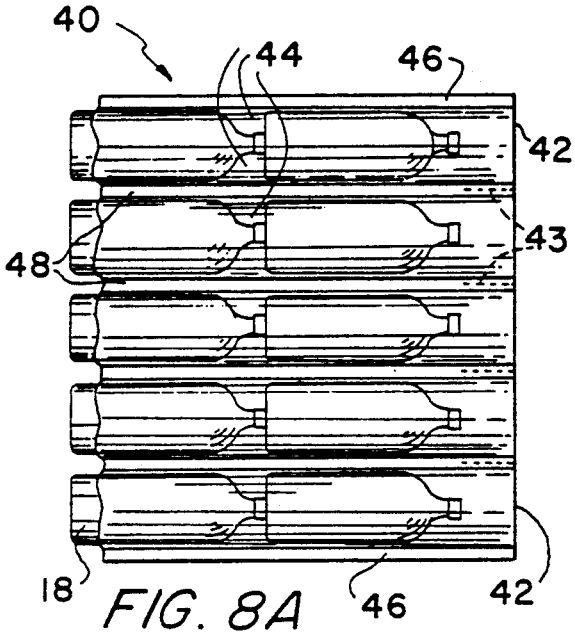
FIG. 8A is a partial top view of a cushion provided with a plurality of compartments having separate access openings.
Figure 8B:
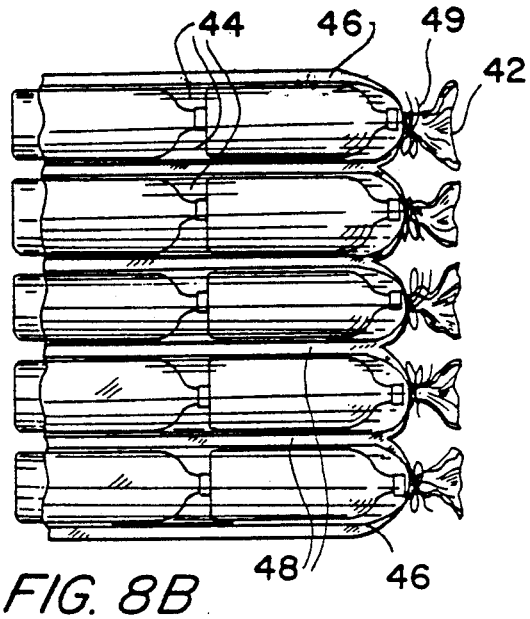
FIG. 8B is a partial top view of the same cushion shown in FIG. 8A with each access opening closed by a closure such as a twist tie.

The bag-like container is provided with an access into the one or more compartments of the bottle envelope to enable positioning containers or bottles within the compartments. Further, each access opening may be provided with a closure to lock or seal or otherwise retain the one or more containers within the compartment. The closure is preferably of a type that would require little or no tools and would allow easy and secure closure after placing one or more containers in the compartments of the cushion. One example of such a cushion 40 is shown in FIGS. 8A and 8B. In this embodiment, the ends 42 of the compartments 44 are constructed with accesses for enabling a plurality of bottles 18 to be slipped through these accesses to fully construct the cushion. These ends 42 can be constructed by heat sealing the cushion 40 at perimeter portions 46 and longitudinal row portions 48 with an iron or hair dryer, for example. The longitudinal row portions 48 are each cut or severed at 43 for a distance from the edge of the sheets to allow each compartment 44 to be sealed off by a tie 49, as shown in FIG. 8B.

Figure 9B:
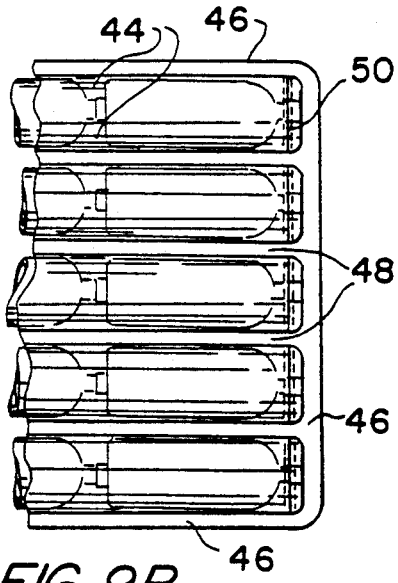
FIG. 9B is a partial top view of the embodiment shown in FIG. 9A in the closed position.
Figure 9A:
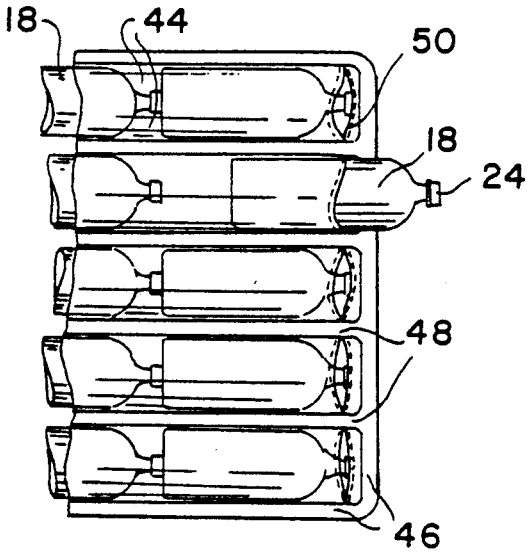
FIG. 9A is a partial top view of a cushion showing plural accesses provided with resealable sealing strips.
Figure 9C:
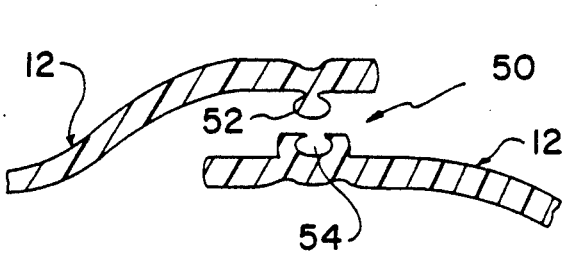
FIG. 9C is an exploded view of a cross-section of the resealable sealing strip utilized in the embodiment shown in FIG. 9A.

Another closure useful in the present invention is shown in FIGS. 9A and 9B. In this embodiment, the ends of the compartments 44 are each provided with a zipper or a resealable sealing strip 50 to allow bottles to be loaded into the compartments 44 as shown in FIG. 9A. A detailed view of the sealing strip 50 is shown in FIG. 9C. The sealing strip 50 includes a male portion 52 and female portion 54 along the length of the strip 50 to provide a seal that can be repeatedly opened and closed, and that can provide adequate tightness.

Figure 10A:
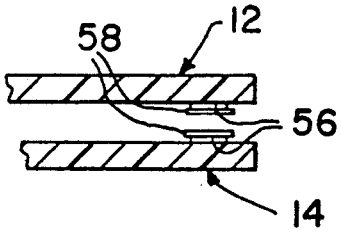
FIG. 10A is a partial detailed cross-sectional view of a cushion having an access opening provided with adhesive strips having protective strips.
Figure 10B:
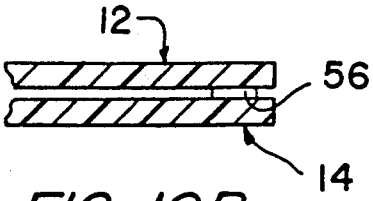
FIG. 10B is a partial detailed cross-sectional view of the embodiment shown in FIG. 10A with the access opening in a closed condition.
Figure 10C:
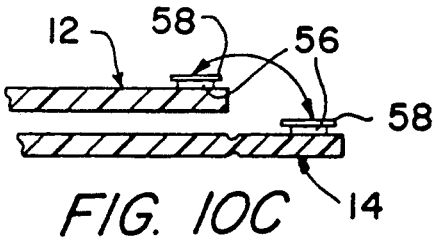
FIG. 10C is a partial detailed cross-sectional view of an alternative embodiment of the access opening of the cushion shown in FIG. 10A.
Figure 10D:
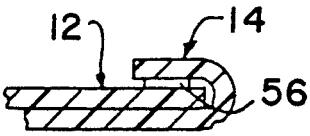
FIG. 10D is a partial detailed cross-sectional view of the embodiment shown in FIG. 10C in a closed position.

A further embodiment of a suitable closure for the compartments of the cushion is shown in FIGS. 10A–10D. In this embodiment, the end of each compartment is provided with an access between the upper sheet 12 and lower sheet 14. At least one of the sheets is provided with a contact adhesive strip 56 covered with a removable protective strip 58. The removable protective strip 58 is removed just prior to closure to allow the contact adhesive strip 56 to come in contact with the other sheet to seal the compartment. In a related alternative embodiment as shown in FIGS. 10C and 10D, one of the sheets is provided with a flap portion with either the flap portion, the other sheet or both provided with a contact adhesive strip 56 covered with a protective strip 58. The protective strip is simply removed and the flap portion 60 folded over on top of the other sheet to provide a substantially permanent seal.

Figure 11A:
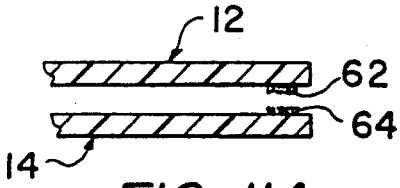
FIG. 11A is a partial cross-sectional view of an embodiment of the cushion having an access opening provided with Velcro® strips.
Figure 11B:
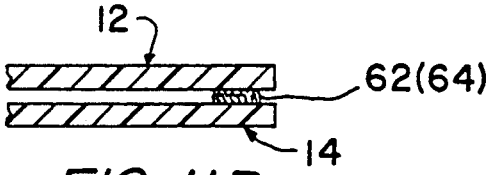
FIG. 11B is a partial detailed cross-sectional view of the embodiment of the cushion shown in FIG. 11A, with the access opening in a closed position.
Figure 11C:
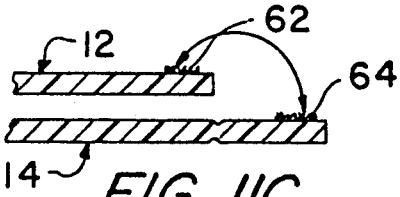
FIG. 11C is a partial detailed cross-sectional view of an alternative embodiment of the cushion shown in FIG. 11A.
Figure 11D:
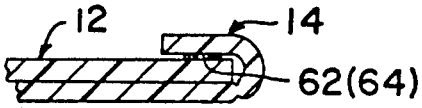
FIG. 11D is a partial detailed cross-sectional view of the cushion shown in FIG. 11C, with the access opening in a closed position.

Another embodiment of a closure suitable for use in the present invention is shown in FIGS. 11A–11D. In this embodiment, the ends of the compartments are provided with hook and loop fastening strips, such as Velcro® mating strips 62 and 64, on inside portions thereof. The bottles 18 are loaded through these ends of the compartments followed by sealing of the compartments by simply applying pressure on the outer surfaces of the sheets at the location of the mating Velcro® strips 62 and 64 providing a seal that can be reopened repeatedly. A related alternative embodiment is shown in FIGS. 11C and 11D in which one sheet is provided with a flap portion 60 with the Velcro® strips arranged as shown to allow the flap to be securely closed. The Velcro® strips can be attached to these sheets by fasteners and/or adhesive.

Figure 12A:
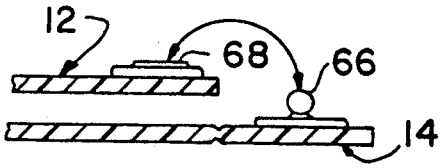
FIG. 12A is a partial detailed cross-sectional view of an embodiment of the cushion having an access opening provided with a snap fastener.
Figure 12B:
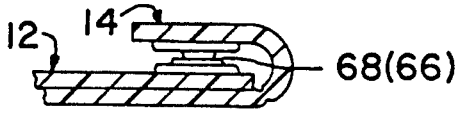
FIG. 12B is a partial detailed cross-sectional view of the cushion shown in FIG. 12A, with the access opening in a closed position.
Figure 12C:
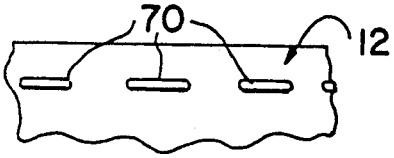
FIG. 12C is a partial top view of an embodiment of the cushion having access openings closed by stitching.
Figure 12D:
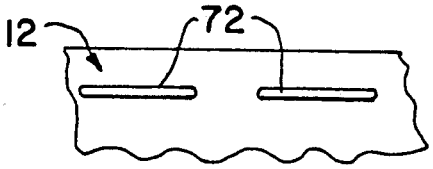
FIG. 12D is a partial top view of an embodiment of the cushion having access openings closed by staples.

Other closures suitable for use in the present invention are shown in FIGS. 12A–12C. In the embodiment shown in FIG. 12A, the end of each compartment is provided with a snap fastener 68. In FIG. 12B, the lower sheet is provided with a flap portion. In FIG. 12C the ends of each compartment are stitched closed by stitching 70. In FIG. 12C, the end of each compartment is closed by one or more staples 70.

The sheets of the cushion and the bag-like container or bottle envelope can be made of various materials as discussed above, and can be solid and/or provided with a plurality of perforations. For example, the sheets may consist of netting material 74 as shown in the embodiment shown in FIG. 14. If a cushion is constructed of netting material and used, for example, as a raft, water can freely circulate around the sealed bottles during use and can readily drain therefrom after use. In contrast, if the sheets are made of solid material sheets and are provided with one of the above discussed closures, water or condensation may tend to build up within the sheets causing adverse functioning of the buoyant cushion or raft for a particular purpose and/or deterioration with time. Water build up within the compartments also makes the cushion heavier for carrying it around. Thus, in some use situations netting material or other perforated type materials are more preferable.

Figure 14:
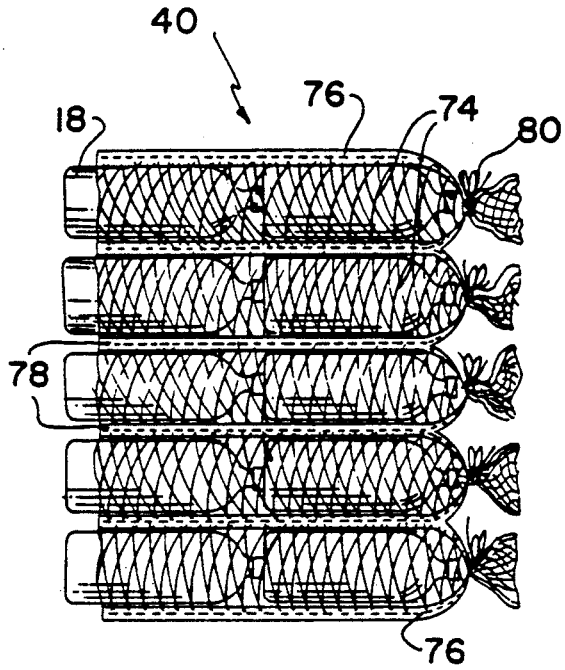
FIG. 14 is a top view of an opposite end of the embodiment of the cushion shown in FIG. 13.
Figure 13:
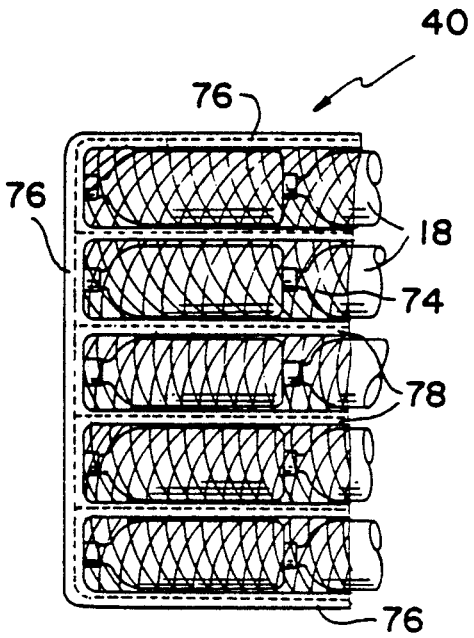
FIG. 13 is a partial top view of the an embodiment of the cushion according to the present invention having netting material as the flexible sheets.

In embodiments of the present invention, cushions may be made from sheets of both netting material and perforated or unperforated sheet material. The sheets may, for example, be made with solid portions at positions where the sheets will be connected together to accommodate additional stress at these points to increase the wear life and durability of the completed product. For example, as shown in FIGS. 13 and 14, the perimeter portions 76 and row portions 78 are made of solid sheet material (i.e. not netting material).

Figure 15:
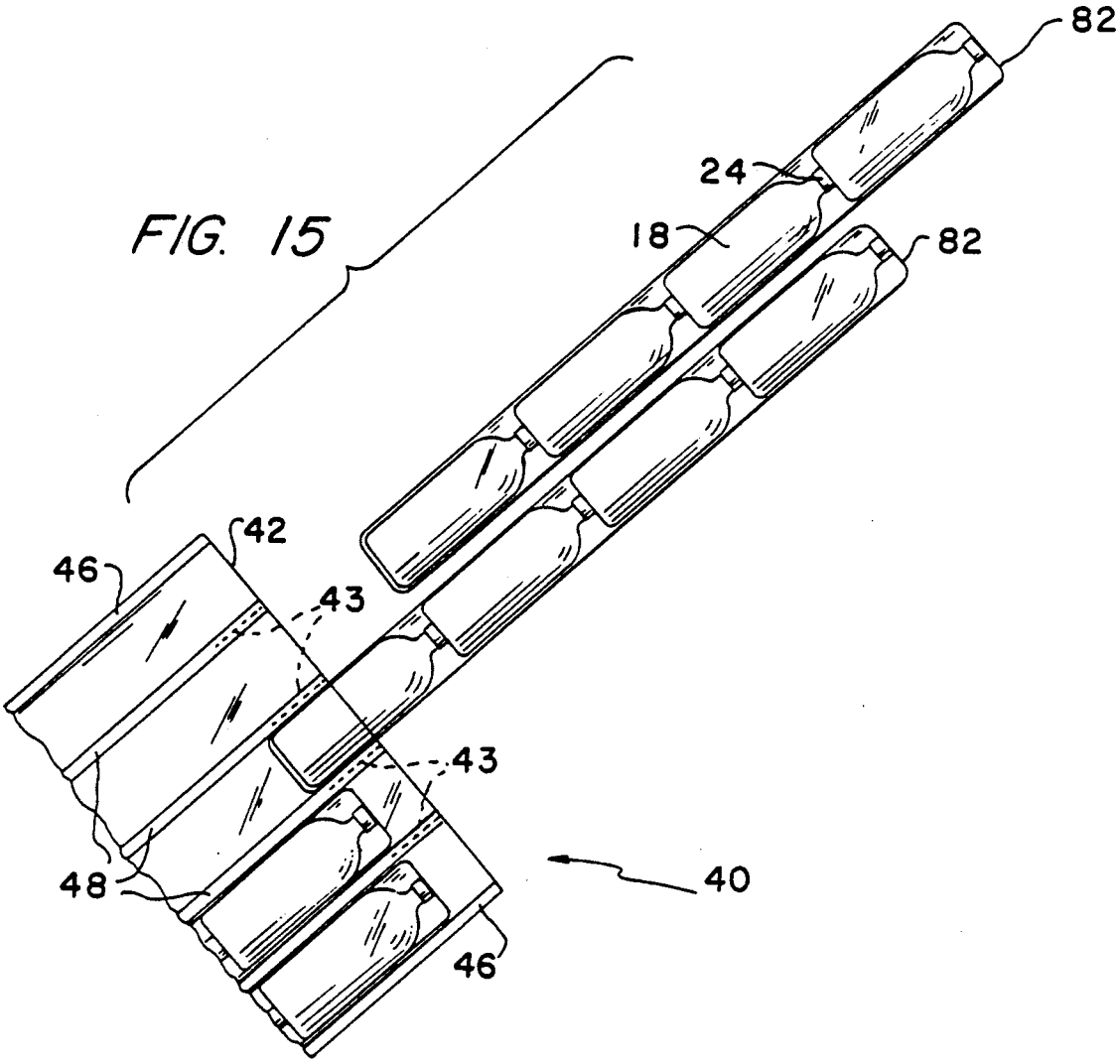
FIG. 15 is a top view of another embodiment of the cushion according to the invention being filled with a plurality of single compartment cushions.

In a more rugged or industrial type use setting, the thickness of the sheets may be increased and/or stronger materials having higher tensile strengths may be utilized to increase the durability of the product. Alternatively, additional layers of material in the construction can provide a similar increased tensile strength. For example, as shown in FIG. 15, separate individual cushions 82 each constructed of a single compartment having one or more containers or bottles 18 disposed therein are inserted into cushion 40 to provide a durable construction. The cushion envelope in this embodiment provides an extra layer of material surrounding the air-filled containers to increase the puncture resistance of these containers and provide increased strength throughout the completed structure.

As mentioned above, used or discarded beverage bottles are preferably used as the containers of choice for making the cushion or filling the bag-like container or cushion envelope according to the present invention. Once a container is emptied of its contents, it is typically washed, dried and provided with a cap tightly screwed onto the mouth or neck end thereof. In embodiments of the present invention it is important that the bottles remain tightly sealed during use of the cushion so that the bottles do not lose air or fill with water or other liquids deteriorating the functions of the bottles, i.e., providing a stable structure, support, thermal insulation, sound insulation, cushioning, buoyancy, etc. The bottles may be pressurized or contain a vacuum but preferably their internal pressure is atmospheric.

To ensure a tight seal, the caps may be provided with a layer of adhesive or sealer on the surface of their threaded portions. For example, silicone sealer can be applied to the threaded portions of both the cap and mouth of the bottle prior to tightly screwing the cap onto the bottle. This feature is shown in FIG. 13 wherein a layer of silicone sealer 88 is provided between the cap and bottle.

The separate individual cushion sections 82 discussed above can be provided with means for connecting a plurality together to form a useful structure as shown in FIGS. 17A and 17B. In these embodiments, adhering strips such as Velcro® strips can be provided along the lengths of the individual cushion sections to provide a completed structure, and which can be attached and detached repeatedly. As shown in FIG. 17C, the individual cushions 82 can be bundled together for storage purposes or for use such as a buoy.

Figure 18B:
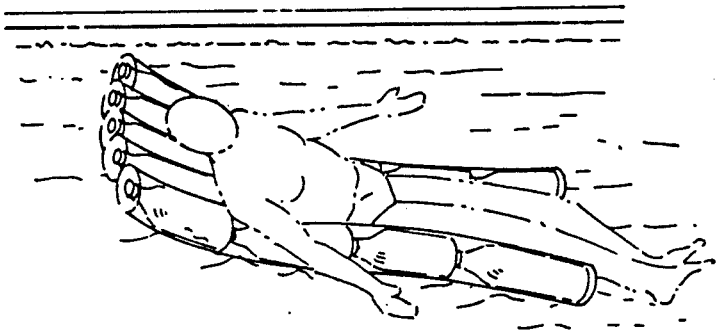
FIG. 18B is an illustration of a cushion according to the present invention adapted for use as a raft.
Figure 18C:
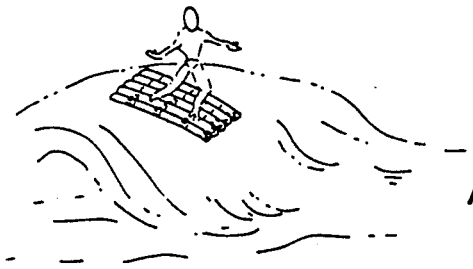
FIG. 18C is an illustration of a cushion according to the present invention adapted for use as a surfing device.
Figure 18D:
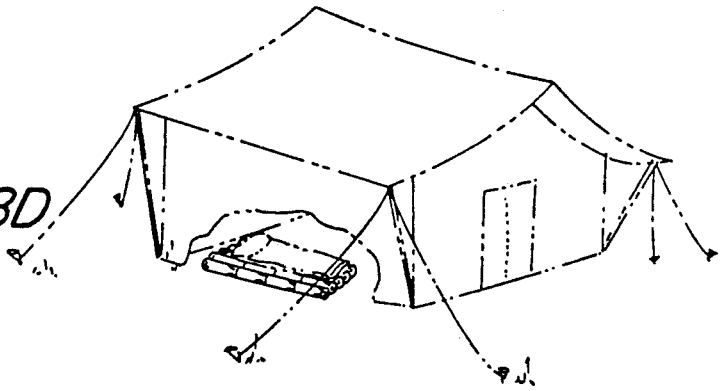
FIG. 18D is an illustration of the cushion according to the present invention adapted for use as a ground mat for a sleeping bag.

The cushion and bag-like containers according to the present invention can be used for numerous functions or activities. For example, the cushion can be constructed or adapted to be utilized as a sunning mat wherein, for example, the sheets of material are soft and comfortable to the skin such as terry cloth covered plastic, as shown in FIG. 18A. Alternatively, the cushion can be adapted for use as a raft or surfing device as shown in FIG. 18B and 18C. In this use, the outer sheets can be made of flexible sheets tightly sealed together to prevent influx of water during use or can be netting material to allow the water to drain therefrom after use. The containers are preferably both air tight and water tight to prevent the containers from losing their buoyancy throughout the life of the raft. In a similar embodiment, the cushion can be used as a base or support for a sleeping bag as shown in FIG. 18D.

Figure 19:
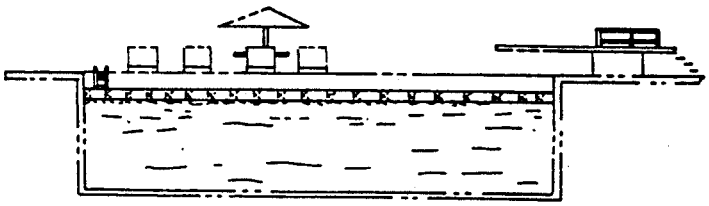
FIG. 19 is an illustration of the cushion according to the present invention adapted for use as a pool cover.

The cushion according to the present invention can be constructed to form a pool cover as shown in FIG. 19. The completed pool cover may have the shape and size of the pool at the water level. The pool cover can be constructed of a plurality of buoyant cushions connected together. Alternatively, the pool cover can be a single cushion having numerous compartments evenly spaced across the entire dimensions of the pool or at specific locations to float portions of the sheets therebetween. The pool cover would typically be formed of sheets of plastic material. The sheets of plastic can be colored blue to simulate the color of water or can be colored a dark opaque color to absorb heat from the sun's rays or made of reflective material to prevent heat absorption for use in extremely sunny locations.

Figure 20:
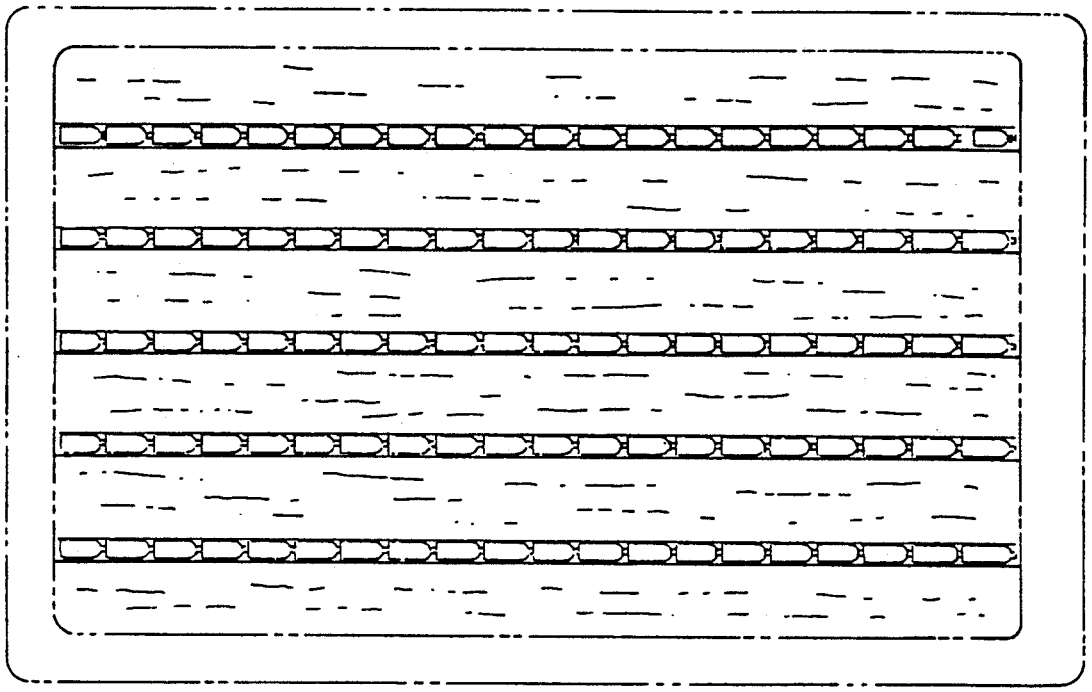
FIG. 20 is an illustration of the cushion according to the present invention adapted for use as lane markers in a swimming pool for practice or racing.

The cushion according to the present invention can be formed into lane markers for use in a swimming pool during swim practice or racing as shown in FIG. 20. A plurality of single compartment cushion sections can be attached end-to-end to form lane markers the length of the pool. The single compartment sections can be connected together with couplers that prevent rotation or allow rotation between sections. A plurality of cushions can be mounted on a cable stretched the length of the pool.

Figure 21:
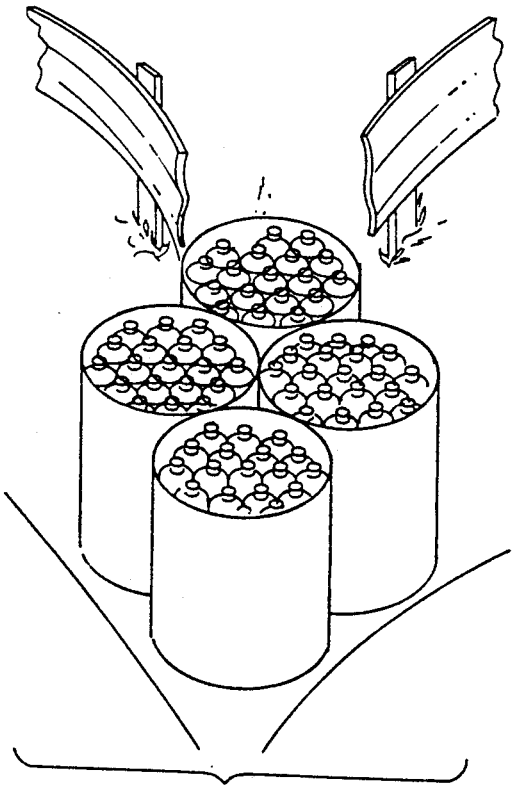
FIG. 21 is an illustration of the cushion according to the present invention adapted for use as a highway barricade.

The cushion according to the present invention can be utilized to form highway or road barriers as illustrated in FIG. 21. The barriers can be constructed of large containers having a plurality of individual cushions or attached cushions contained therein. The barriers can be specifically constructed or tailored to various applications such as protecting vehicles from directly impacting with the ends of guard rails, bridges and other road hazards. For example, the cushions can be constructed of containers that burst at the same or different pressure levels arranged in specific manners to decelerate an impacting vehicle in a controlled manner to reduce vehicle damage and personal injury.

Figure 22:
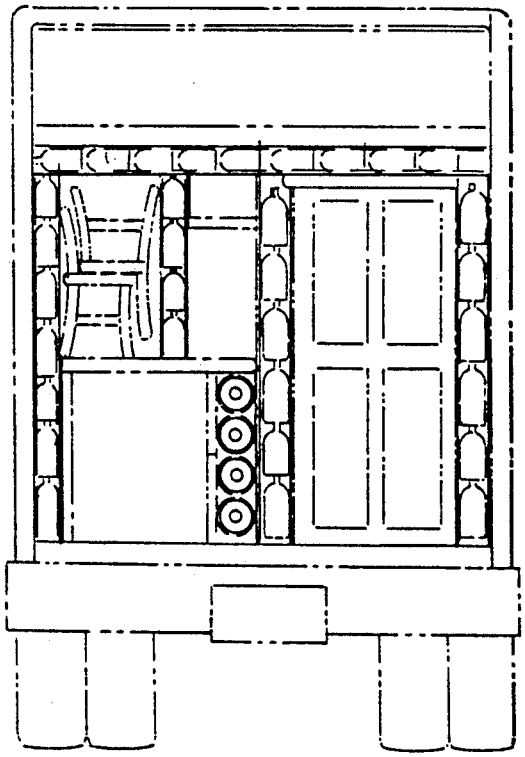
FIG. 22 is an illustration of plural cushions according to the present invention adapted for use as partitions and cushions for moving or storing articles.

The cushions according to the present invention can be utilized for making units to facilitate storage and moving as illustrated in FIG. 22. These cushions can provide walls or containing structures within larger containers such as the storage area of a moving van to facilitate dense loading of packages and materials as illustrated, without damage thereto.

Figure 23:
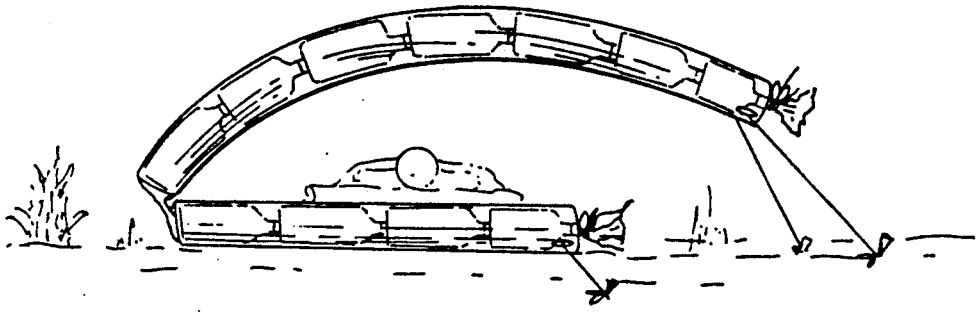
FIG. 23 is an illustration of a cushion according to the present invention adapted for use as a temporary covered shelter or tent.
Figure 24:
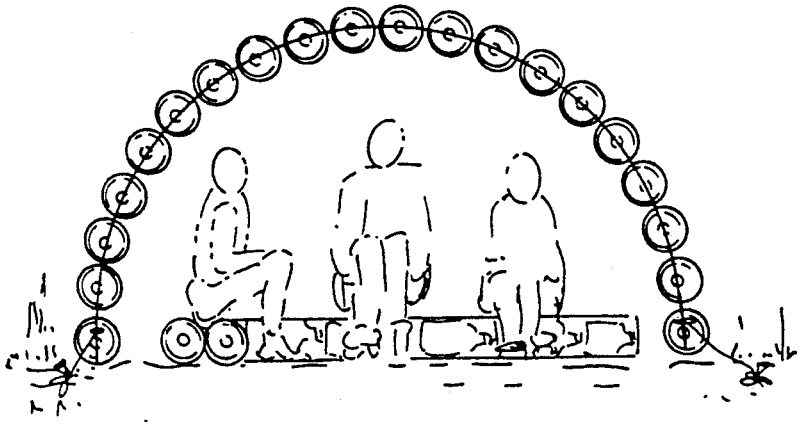
FIG. 24 is an illustration of an alternative cushion according to the present invention adapted for use as a temporary covered shelter or tent.

The cushion according to the present invention can be constructed into a temporary covered shelter or tent as shown in FIGS. 23 and 24. Various tension structures, for example, can be created by using the more rigid bottle arrangements for the cushions of the present invention. Rigid sections may be separated by flexible sections. The flexible sections may be created by leaving a compartment devoid of a row or column of bottles. For example, as shown in FIG. 23, a roof portion is created by attaching one end of the roof via an empty compartment to a lower unit anchored by the weight of the person resting thereon. The free end of the roof may be anchored, for example, by lines connected to stakes. In FIG. 24, the individual cushions are positioned closely enough together to form a substantially rigid flat unit, the ends of which can be bent downwardly and anchored to form an arch which may be supported by optional poles (not shown).

Figure 25:
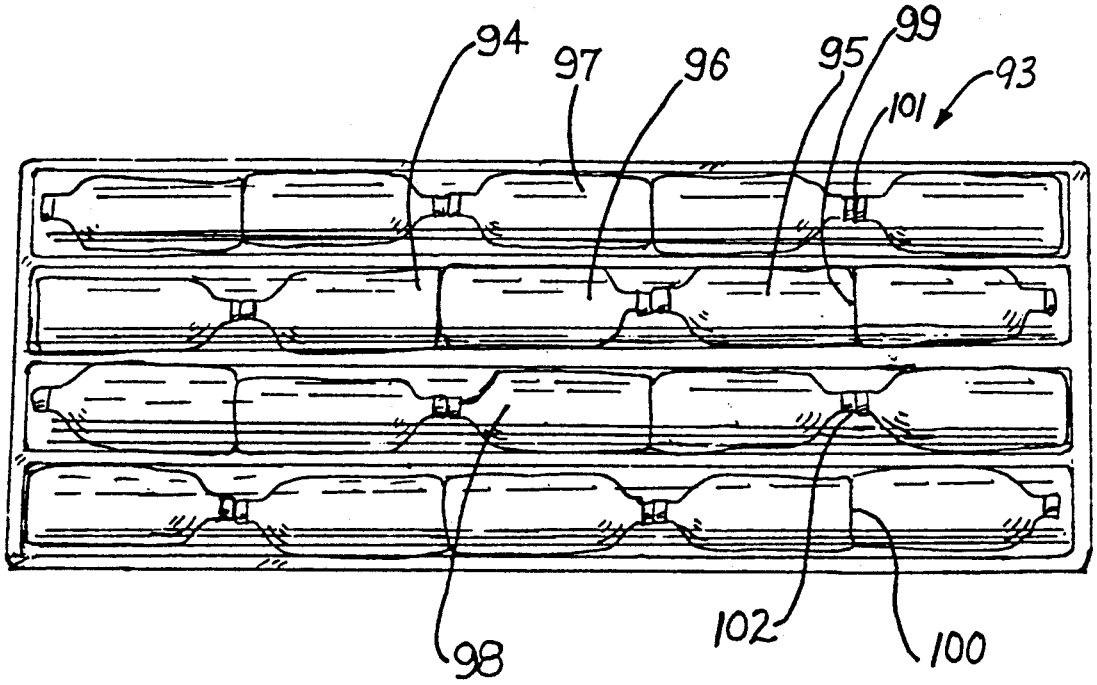
FIG. 25 is a top view of a cushion of the present invention having bottles arranged in an end-to-end relationship which provides a relatively rigid structure.

The most rigid or least flexible structure in a direction transverse to the longitudinal axes of the bottles is obtained when all adjacent bottles (longitudinally adjacent and laterally adjacent) are oriented in opposing directions as shown in FIG. 25. For example, in cushion 93 bottles 94 and 95 are longitudinally adjacent bottle 96. Bottles 97 and 98 are latitudinally adjacent bottle 96. Bottles 94, 95, 97, and 98 are oriented in an opposing direction to bottle 96. Rigidity is obtained in the latitudinal direction across the cushion 93 by the rigid bottom to bottom joints or relationships such as 99 and 100 which counteract the flexible neck-to-neck joints or relationships, such as 101 and 102.

Figure 26:
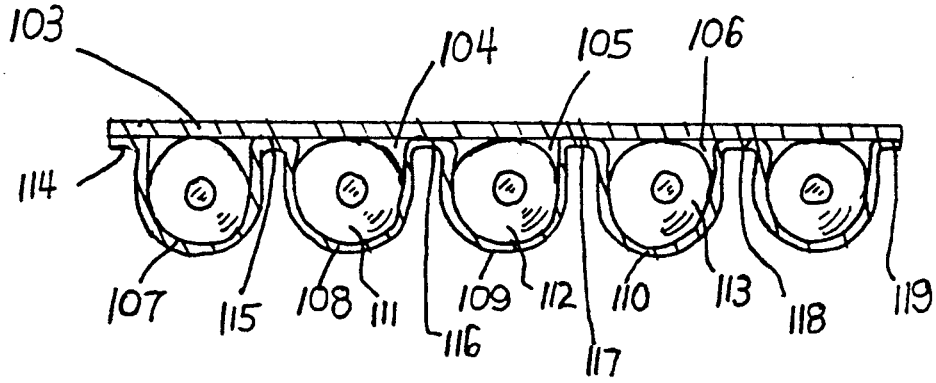
FIG. 26 is a cross-sectional view of a cushion of the present invention having a flat sheet which is preferred for the inclusion of indicia thereon.

In the embodiment of FIG. 26, the top sheet 103 is flat which is preferred for including logos or other indicia on the surface thereof which extend across a plurality of compartments, such as compartments 104, 105, and 106. The bottom sheet 107 is formed into curved sections, such as sections 108, 109, and 110 to configure to the shape of the bottles 111, 112, and 113. The bottom sheet 107 may be attached to the top sheet 103 at seams 114, 115, 116, 117, 118, and 119 by conventional means in known manner such as by heat sealing, glueing, sewing, and the like. The top sheet and the bottom sheet may be made of the same or different materials.

What is claimed is:

1. A cushion comprising (a) a plurality of compartments formed from at least one flexible sheet, the compartments being configured so as to receive and to maintain a plurality of bottles in end to end relationship within each compartment, (b) a plurality of bottles arranged in end to end relationship within the compartments, and (c) means for closing the compartments.

2. A cushion as claimed in claim 1 wherein said bottles are gas filled and capped, whereby said cushion is buoyant.

3. A cushion as claimed in claim 1 wherein at least one of said flexible sheets is perforated.

4. A cushion as claimed in claim 1 wherein at least one of said flexible sheets has a substantially flat portion which contains indicia.

5. A cushion as claimed in claim 1 wherein each of said compartments are oriented substantially parallel to each other.

6. A cushion as claimed in claim 5 wherein in at least one compartment at least a portion of the bottles are arranged such that only every other bottle has its bottom facing the same direction whereby a repetitive neck-to-neck, base to base configuration is obtained.

7. A cushion as claimed in claim 5 wherein at least a portion of the bottles are arranged in neck to neck or base to neck relationship to provide at least one flexible region to said cushion which configures to the human body.

8. A cushion as claimed in claim 7 wherein a portion of the bottles are arranged in base-to-base relationship to provide regions which are more rigid than regions which contain bottles in neck-to-neck or base-to-neck relationship.

9. A cushion as claimed in claim 5 wherein at least substantially all adjacent bottles are oriented in opposing directions to reduce flexibility of the cushion.

10. A cushion as claimed in claim 5 wherein at least substantially all of the bottles are oriented in the same direction.

11. A cushion as claimed in claim 5 wherein said flexible sheets are net-like.

12. A cushion as claimed in claim 5 wherein said sheets are flexible plastic sheets.

13. A cushion as claimed in claim 12 wherein said plastic sheets have a thickness of from about 1 mil to about 10 mil and said compartments are formed by thermosealing.

14. A raft comprising (a) opposing flexible sheets which form a plurality of compartments arranged parallel to each other, (b) a plurality of gas-filled, capped bottles contained in said compartments for imparting buoyancy to said raft, said bottles being arranged in an end-to-end relationship, (c) means for preventing escape of said bottles from said compartments, each of said compartments being sized and shaped so as to maintain a plurality of the bottles aligned in said end-to-end relationship.

15. A raft as claimed in claim 14 wherein at least one of said flexible sheets is perforated.

16. A raft as claimed in claim 14 wherein said flexible sheets have a thickness of from about 1 mil to about 10 mils and at least one of said sheets contains a substantial flat portion which extends across a plurality of compartments, said flat portion containing indicia.

17. A raft as claimed in claim 14 wherein said compartments and bottles are arranged in rows which are substantially parallel to the longitudinal axis of the raft, bottles within a given row being oriented in an opposite direction to each other and to the bottle in the adjacent row.

18. A flexible bag-like container for recycling plastic bottles to form a raft comprising flexible sheets connected to each other to provide a plurality of compartments, each compartment being configured to receive and maintain a plurality of plastic bottles in end-to-end relationship, and means for closing each of said compartments, wherein at least one of said sheets is perforated so water can readily drain from the bag-like container.

19. A flexible container as claimed in claim 18 wherein at least one of said sheets contains indicia which extends across a plurality of said compartments.

20. A flexible container as claimed in claim 18 wherein at least one of said sheets is transparent and the thickness of said sheets is from about 1 mil to about 10 mils.

* * * * *